US006095394A

United States Patent [19]

Wang-Kuan

[11] Patent Number: 6,095,394

[45] Date of Patent: Aug. 1, 2000

[54] PNEUMATIC HAMMER

[76] Inventor: Lin Wang-Kuan, 11F-2, No. 43, Chai-I Street, Taichung, Taiwan

[21] Appl. No.: 09/440,079

[22] Filed: Nov. 15, 1999

[51] Int. Cl.[7] ..... B25C 1/04

[52] U.S. Cl. ..... 227/130; 173/114; 173/131

[58] Field of Search ..... 227/130; 173/131, 173/128, 114

[56] References Cited

U.S. PATENT DOCUMENTS

| | | | |
|---|---|---|---|
| 3,438,449 | 4/1969 | Smith | 227/130 |
| 3,708,096 | 1/1973 | Burke, Jr. | 227/130 |
| 3,813,993 | 6/1974 | Smith | 91/220 |
| 3,854,536 | 12/1974 | Hallock, Jr. | 173/131 |
| 4,867,366 | 9/1989 | Kleinholz | 227/130 |
| 5,074,453 | 12/1991 | Tachihara et al. | 227/130 |
| 5,881,941 | 3/1999 | Lai | 227/130 |

*Primary Examiner*—Scott A. Smith
*Attorney, Agent, or Firm*—Charles E Baxley, Esq.

[57] ABSTRACT

A pneumatic hammer includes a cap connected to a base member with tubular member received in an interior between the cap and the base member. A piston is reciprocatingly received in the tubular member and a piston rod extends from the piston. A spring member is biased between the cap and the tubular member so as to prevent the tubular member from shifting when the pneumatic hammer is put upside down.

12 Claims, 6 Drawing Sheets

PNEUMATIC HAMMER

FIELD OF THE INVENTION

The present invention relates to a pneumatic hammer which has a spring member connected between a cap and a tubular member within which a piston is received. The tubular member is biased so as to maintain the air apertures through the wall of the tubular member to be opened even if the pneumatic hammer is located upside down.

BACKGROUND OF THE INVENTION

A conventional pneumatic hammer generally includes a tubular member received in the body of the pneumatic hammer and a piston is reciprocatingly received in the tubular member. A hammer head is connected to the piston rod located out of the body of the pneumatic hammer so that when pressurized air enters into the tubular member via apertures defined through the tubular member, the piston is pushed to let the hammer head hit an object. After the piston is moved to its lower dead position, pressurized air will enter into the tubular member via another aperture through the tubular member and lift the piston to its higher dead position. Therefore, if the pressurized air continues to enter into the tubular member via the apertures, the piston is moved reciprocatingly to hit the object. It is important that the apertures are maintained to be opened so that pressurized air can enter the interior of the tubular member as desired to actuate the piston. Nevertheless, if the pneumatic hammer is put upside down, the tubular member could shift and the apertures could be blocked. The piston cannot be operated normally if the pneumatic hammer is used to hit an object located above the pneumatic hammer. Furthermore, the pneumatic hammer cannot cooperated with other tool such as a saw.

The present invention intends to provide a pneumatic hammer that prevents the apertures in the tubular member from being blocked when the pneumatic hammer is put upside down. A spring member is biased between a cap of the body of the pneumatic hammer and the tubular member so that the correct position of the tubular member is maintained with regardless of the orientation that the pneumatic hammer is put.

SUMMARY OF THE INVENTION

In accordance with one aspect of the present invention, there is provided a pneumatic hammer comprising a cap having a recessed portion and a plurality of first outlets. A base member has a receiving portion in a center thereof and a neck extends from the base member. The cap is mounted to the base member and located in opposite to the neck and a tubular member is received in the recessed portion of the cap. A spring member is biased between the cap and a first end of the tubular member. A piston is reciprocatingly received in the tubular member and a piston rod extends from the piston. A sleeve is movably received in the receiving portion of the base member and the tubular member snugly extends through the sleeve.

The object of the present invention is to provide a pneumatic hammer that has a spring between the tubular member and the cap so as to prevent the tubular member from shifting too much to ensure that the pneumatic hammer is ready for shoot even if the pneumatic hammer is put upside down.

Another object of the present invention is to provide a pneumatic hammer that has an adapter which is conveniently connected with different tools.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
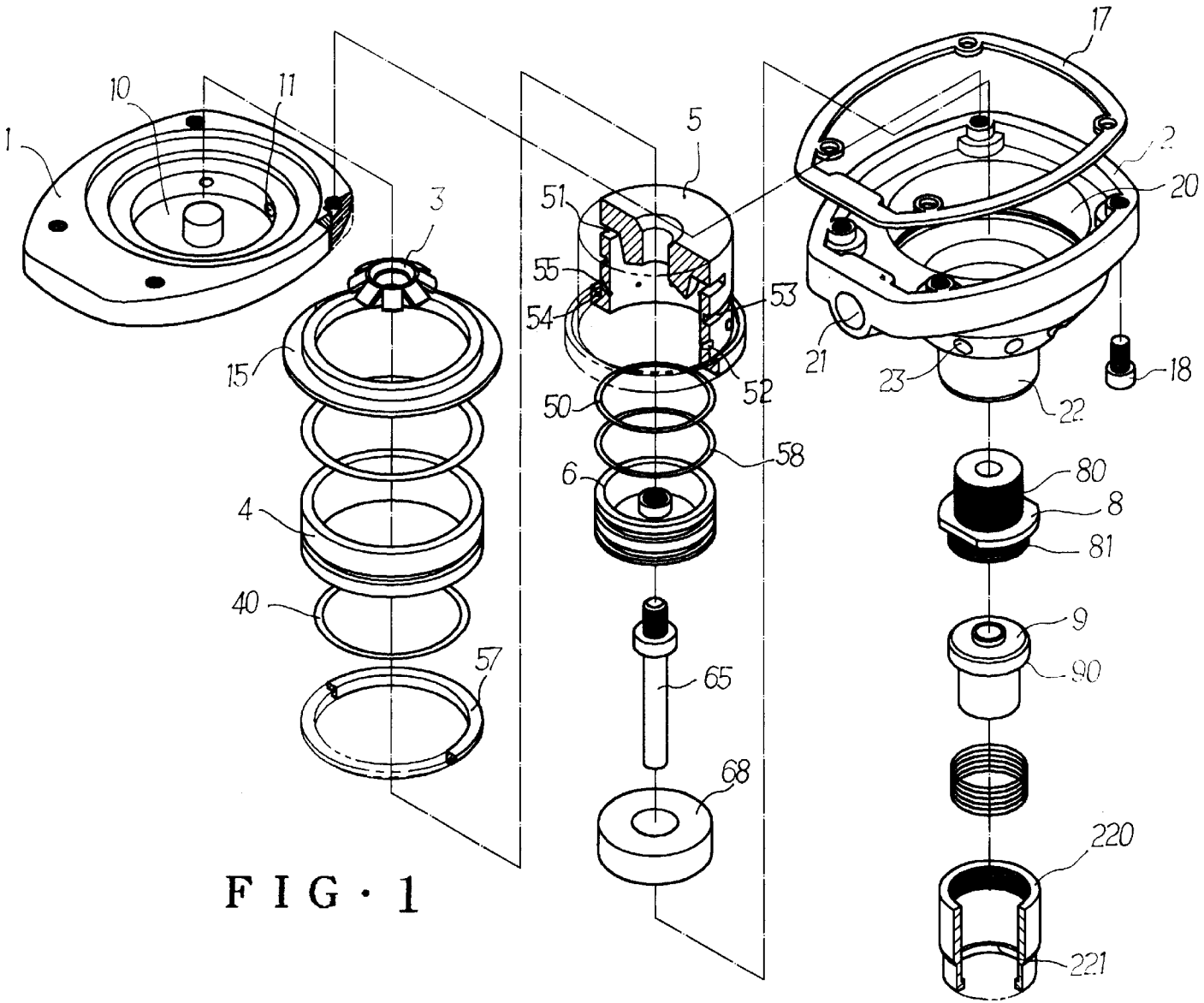
FIG. 1 is an exploded view to show a pneumatic hammer in accordance with the present invention.
Figures 2, 3, 4:
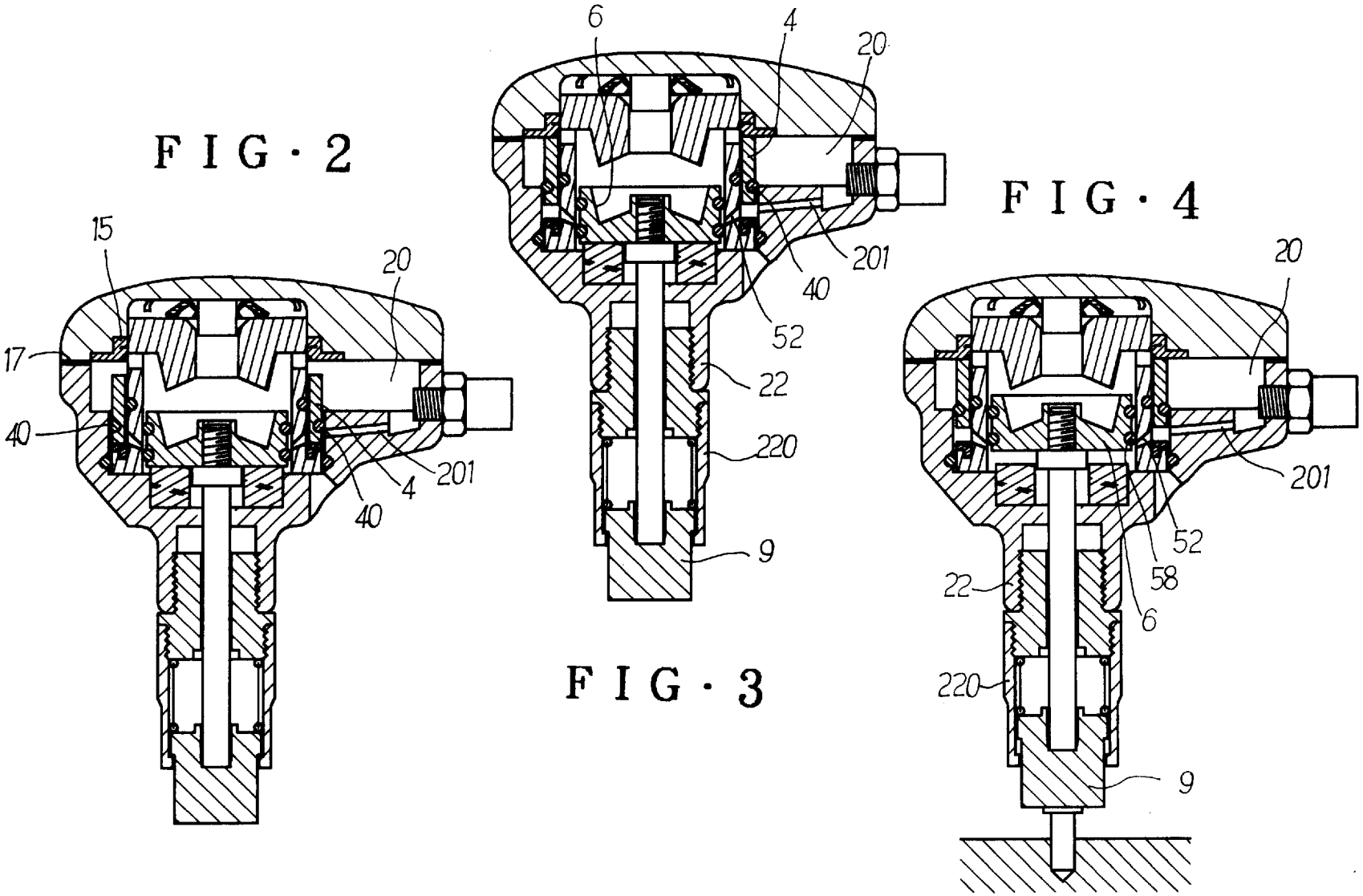
FIG. 2 is a cross-sectional view to show the piston of the pneumatic hammer is located at its lower dead position.
FIG. 3 is a cross-sectional view to show the sleeve is lifted by and the pressurized air entering into the gap between the seals on the sleeve and an inside of the receiving portion of the base member.
FIG. 4 is a cross-sectional view to show the hammer head is to be pressed onto a nail.

Referring to FIGS. 1 and 2, a pneumatic hammer in accordance with the present invention comprises a cap 1 having a recessed portion 10 defined in one side thereof and a plurality of first outlets 11 defined through an inside defining the recessed portion 10 of the cap 1. The first outlets 11 communicate with the recessed portion 10.

A base member 2 has a receiving portion 20 in a center thereof and a neck 22 extends from the base member 2. The neck 22 communicates with the receiving portion 20. A plurality of second outlets 23 and an inlet 21 are respectively defined through the base member 2 and respectively communicating with the receiving portion 20. The cap 1 is mounted to the base member 2 by bolts 18 and is located in opposite to the neck 22 so that the recessed portion 10 of the cap 1 communicates with the receiving portion 20 of the base member 2. A seal 15 is received in a stepped inside defining the recessed portion 10 and a packing 17 is located between the cap 1 and the base member 2. A path 201 defined in the base member 2 and communicates with the inlet 20 and the receiving portion 20.

A tubular member 5 is received in the recessed portion 10 of the cap 1 and the receiving portion 20 in the base member 10. A spring member 3 is biased between the cap 1 and a first end of the tubular member 5 wherein the tubular member 5 having a central hole defined through the first end thereof A first air passage 51 and a second air passage 52 are respectively defined through the wall of the tubular member 5. An annular groove 53 is defined in an outer periphery of the tubular member 5 so as to receive a seal 50 therein. A flange 54 extends radially outward from a lower end of the tubular member 5 and a groove 55 is defined in the flange so that a seal 57 is securely received in the groove 55 in the flange 54.

A sleeve 4 is movably received in the receiving portion 20 of the base member 2 and the tubular member 5 is snugly extending through the sleeve 4. The sleeve 4 has a seal 40 mounted to an outer periphery thereof which contacts the inside defining the receiving portion 20. Normally, as shown in FIG. 2, the path 201 is sealed by the sleeve 4.

A piston 6 is reciprocatingly received in the tubular member 5 and a piston rod 65 extends from the piston 6. A damping member 68 is received in the receiving portion 20 and located between the neck 22 and the piston 6 so as to damp the downward movement of the piston 6.

A connection member 8 has a first outer threaded portion 80 defied in a first end of the connection member 8 so as to threadedly engage with the neck 22, and a second outer threaded portion 81 defined in a second end of the connection member 8 so as to threadedly engage with a tubular casing 220. The piston rod 65 extends through the connection member 8 and a hammer head 9 is connected to a distal end of the piston rod 65. The tubular casing 220 has a stop 221 extending radially inward from an end of the tubular casing 220 and the hammer head 9 has an annular protrusion 90 so that the hammer head 9 contacts the stop 221 to prevent the hammer head 9 from dropping from the tubular casing 220 when the hammer head 9 is moved to its lower position as shown in FIG. 2.

Figures 5, 6, 7:
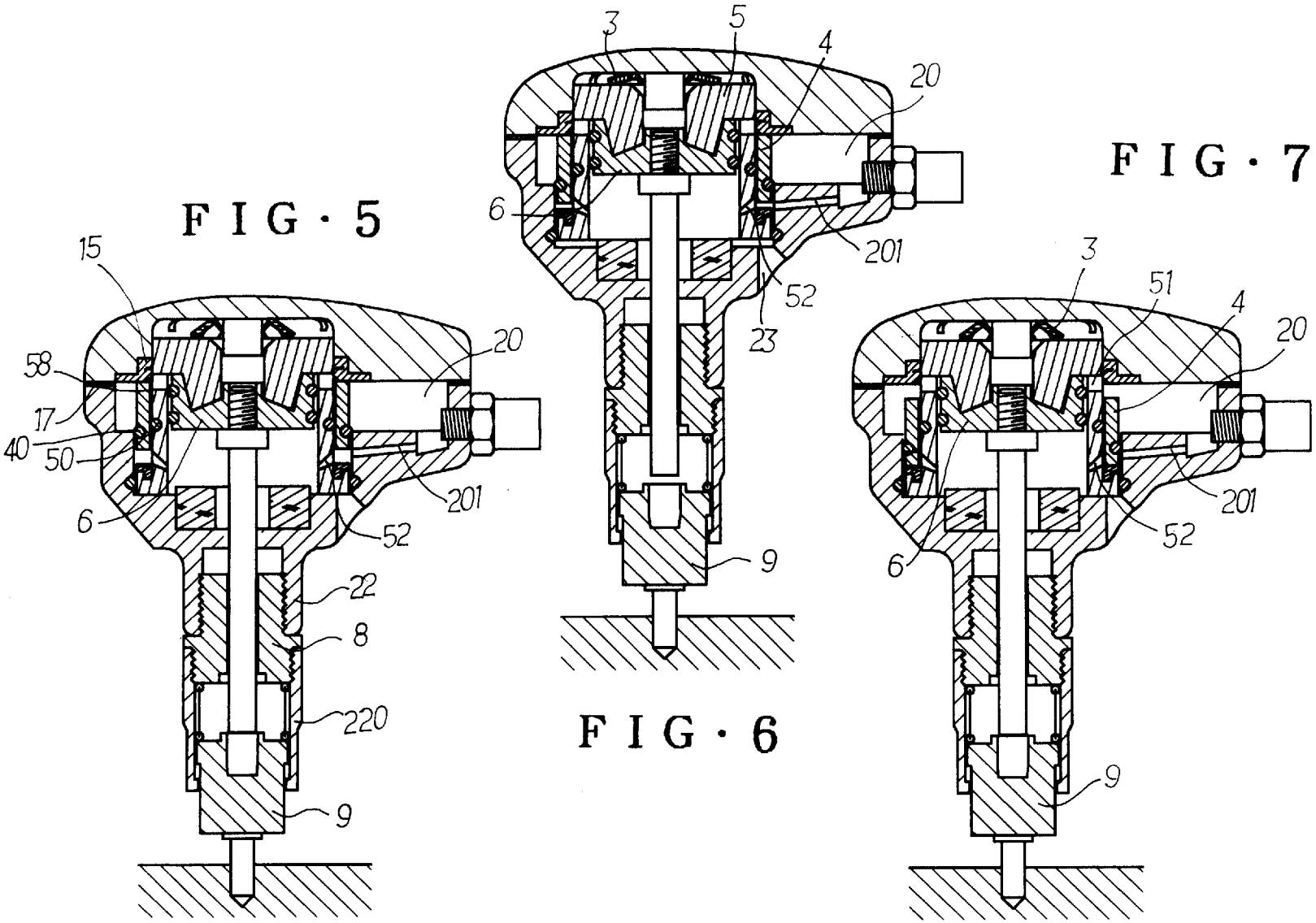
FIG. 5 is a cross-sectional view to show the hammer head is pushed by the fixed nail and the piston is pushed to contact the tubular member.
FIG. 6 is a cross-sectional view to show the hammer head is pushed by the fixed nail and the spring member is compressed by the tubular member, an interior of the tubular member communicating with the outlets in the base member.
FIG. 7 is a cross-sectional view to show the spring member pushes the tubular member and the sleeve to their original position as shown in FIG. 2.

When the pressurized air enters the inlet 20 as the arrows shown in FIG. 2, the pressurized air enters in the path 201 and pushes the seal 40 on the sleeve 4 upwardly as shown in FIG. 3 and therefore the second air passage 52 is opened. As shown in FIG. 4, before impacting an object such as a nail as shown in FIG. 4, the hammer head 9 is pressed onto the nail to let the piston 6 goes toward the cap 1, pressurized air therefore enters in the interior of the tubular member 5 via the second air passage 52 to push the piston 6 to contact the tubular member 5. As shown in FIG. 6, the pressurized air forces the tubular member 5 to be lifted and to compress the spring member 3. In the meanwhile, as shown in FIG. 7, the upward movement of the tubular member 5 opens the second outlets 23, so that the pressure in the path 201 is less than the pressure of the inlet 20 so that higher pressure pushes the seal 40 to let the sleeve 4 again be pushed downward to its original position. Pressurized air pushes the seal 58 on the piston 6 to let the piston 6 move toward the nail.

Figure 8:
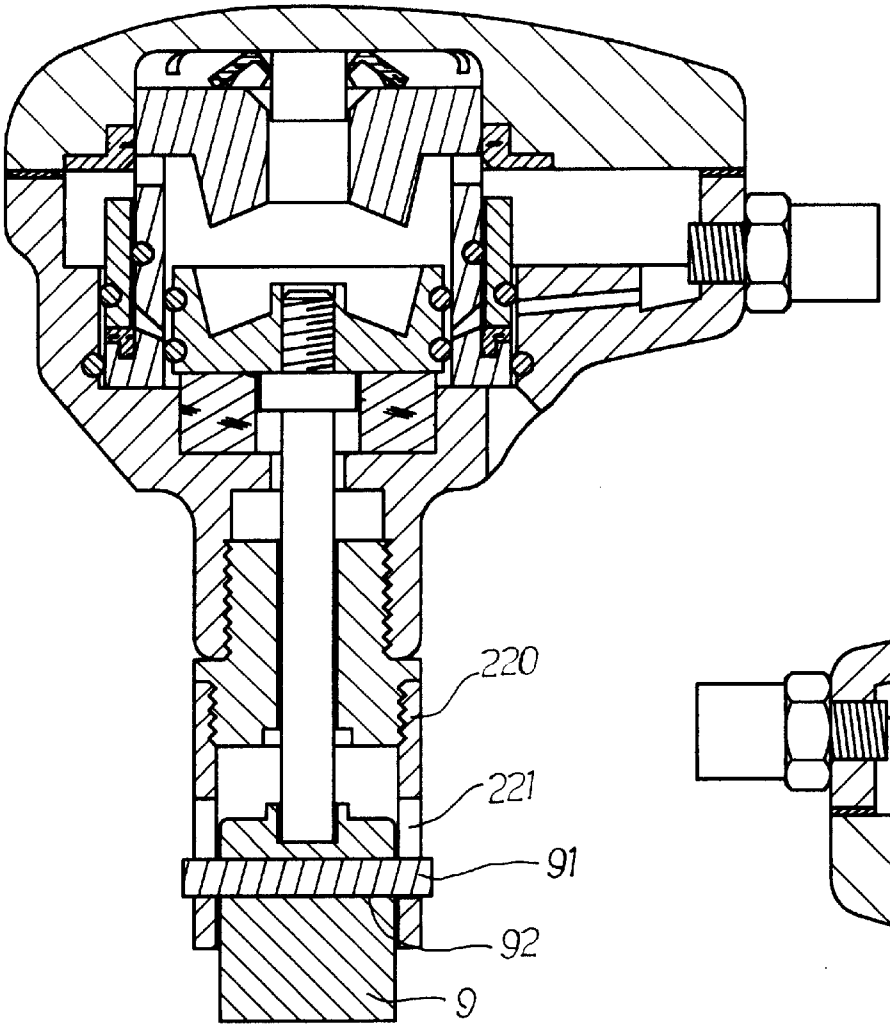
FIG. 8 is a cross-sectional view to show another embodiment of the hammer head and the tubular casing.

FIG. 8 shows that the tubular casing 220 has a transverse hole 221 and the hammer head 9 has a transverse passage 92 for a pin 91 extending therethrough. The pin 91 is movably retained within the transverse hole 221 to limit the range that the hammer head 9 moves.

Figure 9:
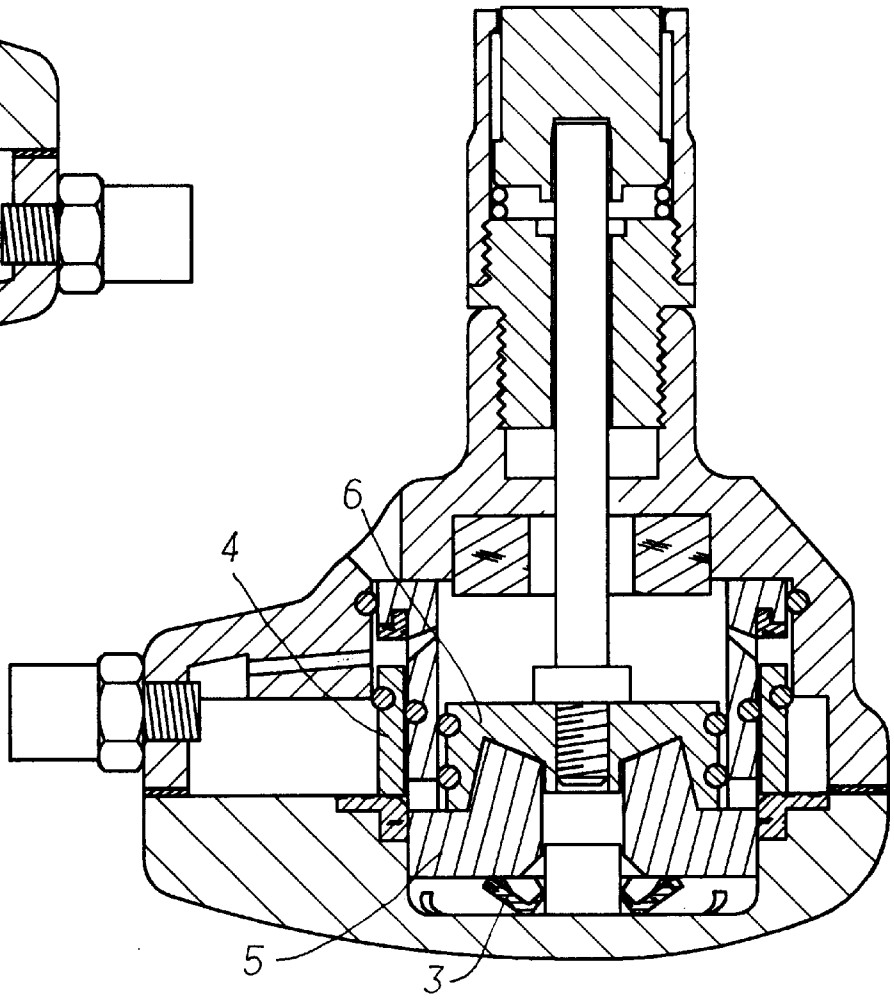
FIG. 9 is a cross-sectional view to show the spring member supports the tubular member and maintain the tubular member at its position.

FIG. 9 shows that when the pneumatic hammer is put upside down, the spring member 3 supports the weight of the tubular member 5 and the piston 6 to ensure the relative position relationship of the sleeve 4 and the tubular member 5 is not changed and ready for another shoot.

Figure 10:
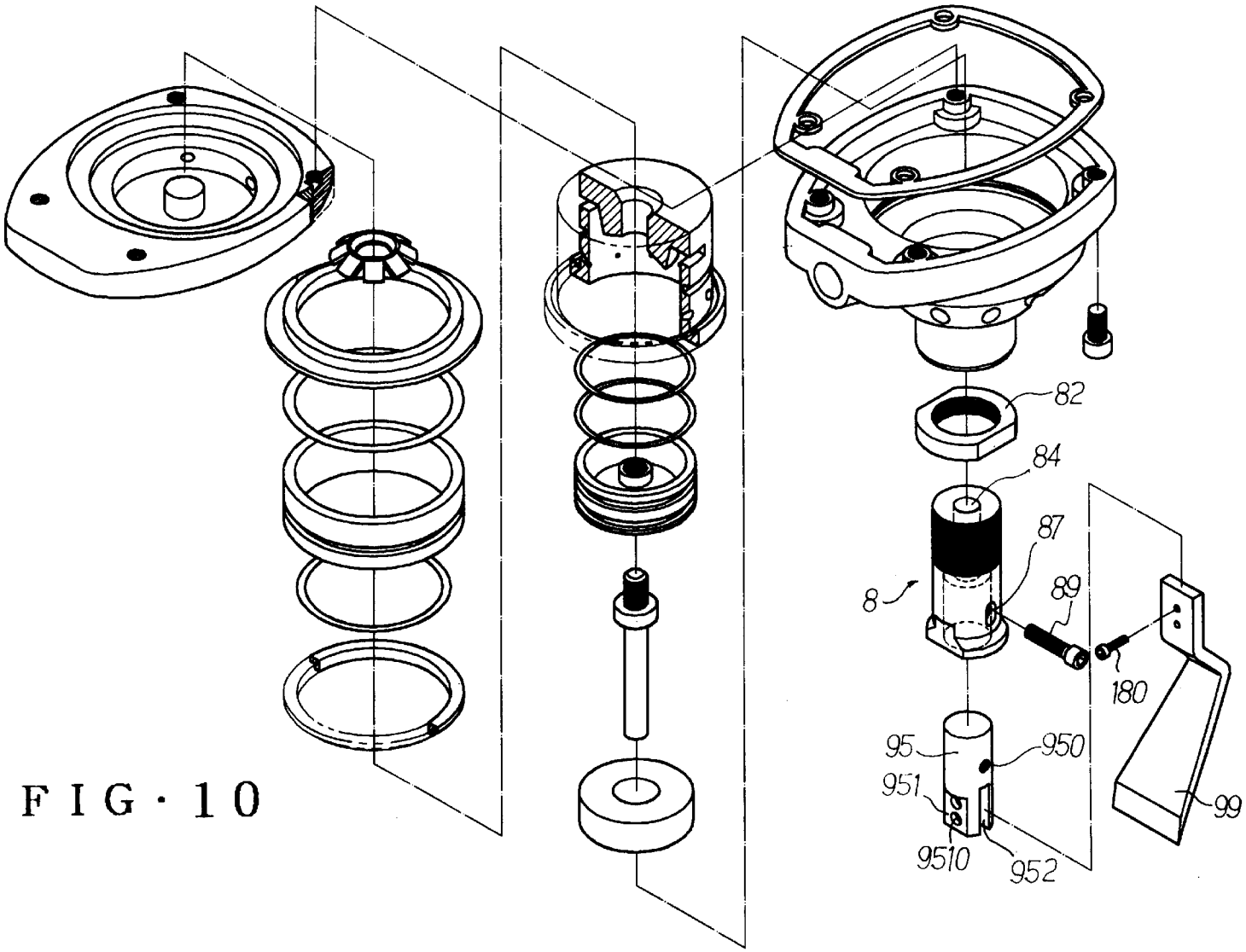
FIG. 10 is an exploded view to show that an adapter is connected to the base member and a shovel is connected to the adapter.

Referring to FIG. 10, the connection member 8 may have a recess 87 defined radially therethrough and the connection member 8 is connected to the neck 22 by a locking nut 82. The connection member 8 has a passage 84 for the piston rod 65 to extend. An adapter 95 has one end thereof received in a lower end of the connection member 8. The adapter 95 has an engaging hole 950 communicating with the recess 87 and a bolt 89 extends through the recess 87 and is engaged with the engaging hole 950 so as to secure the adapter 95 to the connection member 8. The adapter 95 has a slot 952 defined in a distal end thereof and two surfaces 951 are defined in the outside of the adapter 95. The two surfaces 951 are located diametrically in opposite with each other. Two positioning holes 9510 are defined through the two surfaces 951 so that a shovel 99 is received in the slot 952 and secured by bolts 180 through the positioning holes 9510 and the shovel 99.

Figure 11:
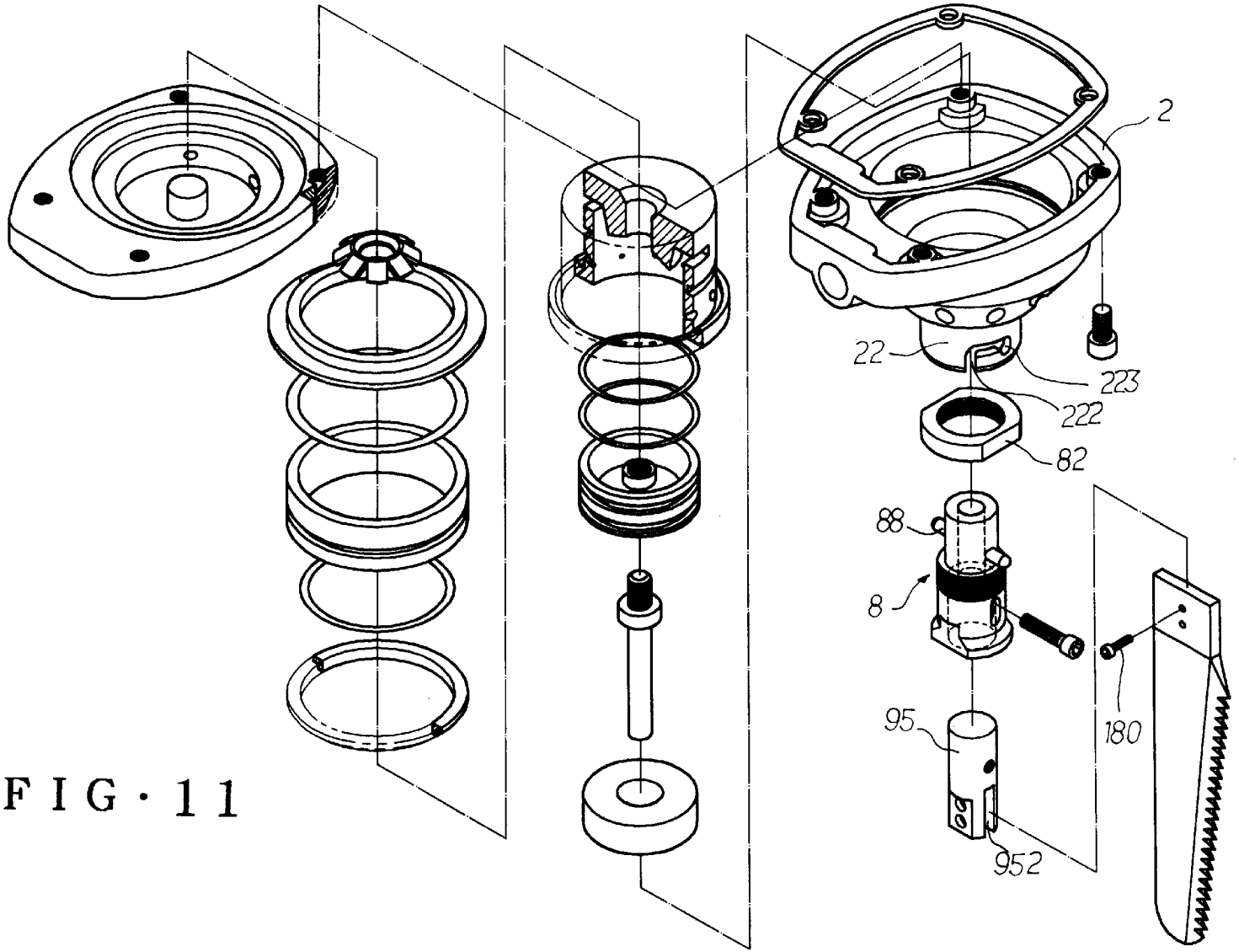
FIG. 11 is an exploded view to show that an adapter is connected to the base member and a saw is connected to the adapter.

FIG. 11 shows that the neck 22 may have two L-shaped grooves 222 and each horizontal portion of the L-shaped groove 222 has a dent 223. The connection member 8 has the same structure as that shown in FIG. 10 except that two protrusions 88 extend radially outward therefrom. The two protrusions 88 are engaged with the two L-shaped grooves 222 in the neck 22 and are secured by engaging with the dents 223. A saw 98 can be securely retained in the slot 952 of the adapter 95 by bolts 180.

The spring member 3 ensures that the tubular member 5 and the sleeve 4 are located in their normal positions even if the pneumatic hammer is put upside down.

While we have shown and described various embodiments in accordance with the present invention, it should be clear to those skilled in the art that further embodiments may be made without departing from the scope and spirit of the present invention.

What is claimed is:

1. A pneumatic hammer comprising:

a cap having a recessed portion defined therein and a plurality of first outlets defined through said cap, said first outlets communicating with said recessed portion;

a base member having a receiving portion in a center thereof and a neck extending from said base member, said neck communicating with said receiving portion, a plurality of second outlets and an inlet respectively defined through said base member and respectively communicating with said receiving portion, said cap mounted to said base member and located in opposite to said neck, said recessed portion of said cap communicating with said receiving portion of said base member;

a tubular member received in said recessed portion of said cap and said receiving portion in said base member, a spring member biased between said cap and a first end of said tubular member, said tubular member having a central hole defined through said first end thereof;

a piston reciprocatingly received in said tubular member and a piston rod extending from said piston, and a sleeve movably received in said receiving portion of said base member and said tubular member snugly extending through said sleeve.

2. The pneumatic hammer as claimed in claim 1 further comprising a connection member connected to said neck and said piston rod extending through said connection member, a hammer head connected to a distal end of said piston rod.

3. The pneumatic hammer as claimed in claim 2, wherein said connection member has a recess defined radially therethrough and an adapter has one end thereof received in said connection member, said adapter having an engaging hole communicating with said recess and a bolt extending through said recess and engaged with said engaging hole.

4. The pneumatic hammer as claimed in claim 3, wherein said adapter has a slot defined in a distal end thereof so as to be adapted to connect a tool with said slot.

5. The pneumatic hammer as claimed in claim 2, wherein said neck has two L-shaped grooves and said connection member has two protrusions extending radially outward therefrom, said two protrusions engaged with said two L-shaped grooves in said neck.

6. A pneumatic hammer comprising:

a cap having a recessed portion defined therein and a plurality of first outlets defined through said cap, said first outlets communicating with said recessed portion;

a base member having a receiving portion in a center thereof and a neck extending from said base member, said neck communicating with said receiving portion, a plurality of second outlets and an inlet respectively defined through said base member and respectively communicating with said receiving portion, said cap mounted to said base member and located in opposite to said neck, said recessed portion of said cap communicating with said receiving portion of said base member;

a tubular member received in said recessed portion of said cap and said receiving portion in said base member, a spring member biased between said cap and a first end of said tubular member, said tubular member having a central hole defined through said first end thereof, said tubular member having a flange extending radially outward therefrom and a groove defined in said flange, a seal securely received in said groove;

a piston reciprocatingly received in said tubular member and a piston rod extending from said piston, and a sleeve movably received in said receiving portion of said base member and said tubular member snugly extending through said sleeve.

7. The pneumatic hammer as claimed in claim 6 further comprising a connection member connected to said neck and said piston rod extending through said connection member, a hammer head connected to a distal end of said piston rod.

8. The pneumatic hammer as claimed in claim 7, wherein said connection member having a recess defined radially therethrough and an adapter has one end thereof received in said connection member, said adapter having an engaging hole communicating with said recess and a bolt extending through said recess and engaged with said engaging hole.

9. The pneumatic hammer as claimed in claim 8, wherein said adapter has a slot defined in a distal end thereof so as to be adapted to connect a tool with said slot.

10. The pneumatic hammer as claimed in claim 7, wherein said neck has two L-shaped grooves and said connection member has two protrusions extending radially outward therefrom, said two protrusions engaged with said two L-shaped grooves in said neck.

11. A pneumatic hammer comprising:

a cap having a recessed portion defined therein and a plurality of first outlets defined through said cap, said first outlets communicating with said recessed portion;

a base member having a receiving portion in a center thereof and a neck extending from said base member, said neck communicating with said receiving portion, a plurality of second outlets and an inlet respectively defined through said base member and respectively communicating with said receiving portion, said cap mounted to said base member and located in opposite to said neck said recessed portion of said cap communicating with said receiving portion of said base member;

a tubular member received in said recessed portion of said cap and said receiving portion in said base member, a spring member biased between said cap and a first end of said tubular member, said tubular member having a central hole defined through said first end thereof;

a piston reciprocatingly received in said tubular member and a piston rod extending from said piston;

a sleeve movably received in said receiving portion of said base member and said tubular member snugly extending through said sleeve, and a connection member having a first outer threaded portion defined in a first end of said connection member so as to threadedly engage with said neck, a second outer threaded portion defined in a second end of said connection member so as to threadedly engage with a tubular casing.

12. The pneumatic hammer as claimed in claim 11, wherein said tubular casing has a stop extending radially inward from an end of said tubular casing, a hammer head connected to a distal end of said piston rod and said hammer head having an annular protrusion, said hammer head contacting said stop to prevent said hammer head from dropping from said tubular casing.

* * * * *